US006458743B1

(12) United States Patent
Menin

(10) Patent No.: US 6,458,743 B1
(45) Date of Patent: Oct. 1, 2002

(54) TRANSFER PRINTING PROCESS

(75) Inventor: Gilberto Menin, Como (IT)

(73) Assignee: Memphis S.r.L., Como (IT)

( * ) Notice: Subject to any disclaimer, the term of this patent is extended or adjusted under 35 U.S.C. 154(b) by 0 days.

(21) Appl. No.: 09/201,126

(22) Filed: Nov. 30, 1998

(30) Foreign Application Priority Data

Dec. 2, 1997 (IT) ..... MI97A2664

(51) Int. Cl.[7] ..... B41M 5/035; B41M 5/38
(52) U.S. Cl. ..... 503/227; 428/913; 428/914
(58) Field of Search ..... 8/471; 428/195, 428/913, 914, 209; 503/227

(56) References Cited

U.S. PATENT DOCUMENTS 4,748,151 A * 5/1988 Murata et al. ..... 503/227
4,853,707 A 8/1989 Kawanishi et al. ..... 346/1.1
5,006,502 A * 4/1991 Fujimura et al. ..... 503/227
5,516,746 A * 5/1996 Ito ..... 503/227
5,602,072 A * 2/1997 Hutt et al. ..... 503/227

FOREIGN PATENT DOCUMENTS

FR 1 479 358 A 7/1967

* cited by examiner

*Primary Examiner*—Bruce H. Hess
(74) *Attorney, Agent, or Firm*—Arent Fox Kintner Plotkin & Kahn, PLLC

(57) ABSTRACT

Transfer printing process wherein the color transfer occurs by sublimation, characterized in that a composite film is used formed, in the order, by a synthetic material film or lamina, which is such as to resist without getting deformed the temperatures reached in the calendering phase which are in the range 170°–210°C., having a thickness ranging from 6 to 100 micron; by an aluminum layer, having a thickness ranging from 50 to 400 Å; by a drawing, with the respective colors, impressed on the aluminum layer.

6 Claims, 4 Drawing Sheets

Figure 1:
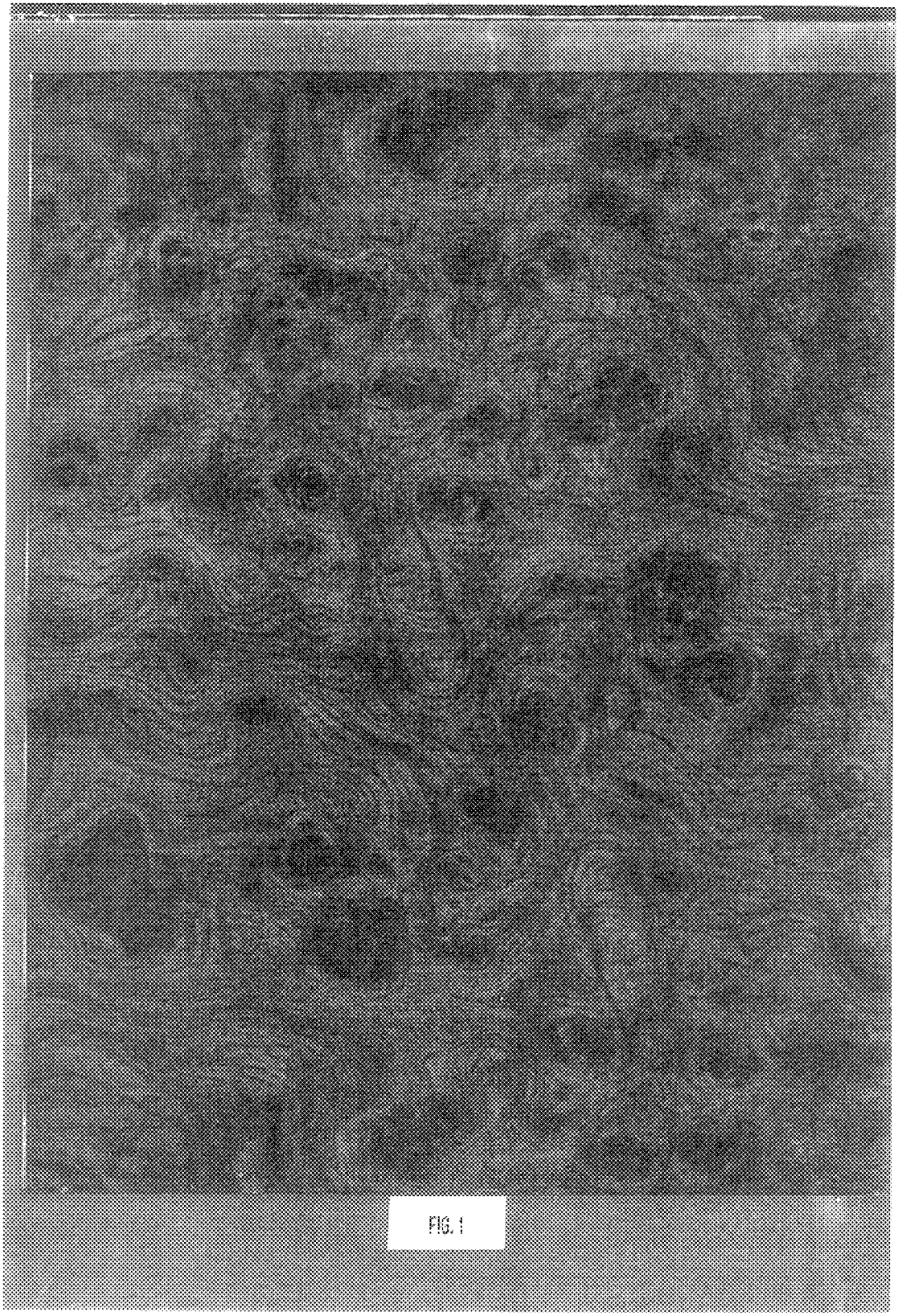

(4 of 4 Drawing Sheet(s) Filed in Color)

TRANSFER PRINTING PROCESS

The present invention relates to a printing process. More specifically it relates to a transfer printing process, wherein the colour transfer takes place by sublimation, which uses a specific composite film.

Still more specifically the process according to the present invention uses a composite comprising a polymeric film as support combined with a metal film which is printed with inks.

It is well known in the art that the transfer print has been used since long time and has a great utilization in the industries of this field. This kind of print differs from the conventional one, since the drawing is first printed on a paper sheet suitable for this kind of print and then, in a subsequent step (transfer printing process), the drawing hot transfer is carried out from the paper support to the definitive one.

In the first step, a rotogravure print process and conventional inks emulsifiable with water or dispersed in solvent are generally used. In the second step, which is the real transfer step, the drawing transfer on the definitive support occurs, for example, in the transfer case by colour direct sublimation, by calendering or in oven at temperatures in the range 170°–210° C. The time required for the second step is generally in the order of some minutes.

The colour transfer is carried out by means of different techniques, mainly by dry or wet printing, as it generally occurs in the textile case.

In the dry print the transfer can occur by direct sublimation, or by making the colours to adhere to thermoplastic resins which are on the receiving support.

According to a wet printing method, hydrosoluble dyes applied on the textile wet fiber are used. The transfer and fixing steps are carried out in conditions similar to those of a normal vaporization and washing.

According to another wet printing method, in a first step the drawing printing is accomplished by thermoplastic thickeners. Then, the transfer on the textile is carried out by calendering at about 150° C. At this point the textile is fixed to the textile by vaporization and washing according to the usual techniques.

It is known that the conventional printing on textile comprises, besides the step in which the drawing is applied on the fibers by a series of tables in a number equal to that of the used colours, also the fixing, washing and finishing steps.

The transfer print shows in comparison with the conventional one the following advantages:

- a more faithful reproduction also of drawings of high complexity (four-colour process);
- lower printing costs since less sophisticated production plants are required;
- reduced environmental effect, since the total amount of dyes dispersed in the environment is very poor;
- elimination of the vaporization, washing and finishing steps, with the respective working recycling.

The transfer printing known in the art shows however some drawbacks as regards the obtained print quality.

The rotogravure printing, as known, allows to obtain high quality level results, therefore with an high imagine definition for very complex drawings too. However in the transfer phase the conventional transfer process limits are shown.

For instance in the colour transfer case by sublimation, the following drawbacks are shown:

- the image definition (D.O.I.), as described later on, is not high. This fact is particularly evident in particular applications, for instance in the printing on rigid-supports;

- the gloss in the printing process results lower;
- the colour amount transferred to the article results not higher than about 60–65%;
- the colour amount dispersed in the environment implies the need of smoke disposal plants;
- the transfer technique can be advantageously used on flat surfaces, but with difficulty for tridimensional articles.

The need was therefore felt to have available an improved printing process allowing to obtain a transfer printing having a better chromatic yield, an improved D.O.I., preferably combined with an improved gloss, a reduction of the smoke disposal plants and a meaningful transfer time reduction.

The Applicant has now unexpectedly and surprisingly found a composite film allowing to obtain the above mentioned advantages, comprising:

- a polymeric material film or sheet, forming the composite base, and capable to resist without decomposition the temperatures reached in the colour transfer step by sublimation, said temperatures preferably being in the range 170°–210° C.; the polymeric material film thickness being in the range from 6 to 100 micron, preferably from 10 to 25 micron;
- an aluminum layer, having a thickness in the range 50–400 Å preferably with an optical density between 1.5 and 3.0 determined with a TD 932-Macbeth densitometer, spread out on the polymeric material film;
- a drawing, with the respective colours, impressed on the aluminum layer.

The polymeric film can be formed by polyesters, fluorinated resins, polyamides, polyimides, polyethers. Preferably a polymer based on polyester, specifically on polyethylene or polybutylen-terephthalate is used.

The metal composite film preparation process is carried out in two distinct phases:

By starting from the polymeric film, having the above feature not to decompose at the colour transfer phase temperatures, and which is in a thin film form, obtainable for instance by extrusion, one proceeds to the metallization with aluminum under high vacuum on one of the two film sides, by using the usual techniques well known to the skilled man.

The film is printed with the drawing to be transferred on the side covered with aluminum, by using offset, flexo, rotogravure, serigraphic printing machines, preferably a rotogravure printing machine.

The used inks are those usually available on the market and, as said, can be emulsifiable with water or disperseable in solvent and they must preferably be of the type with high light resistance.

With the metallized film according to the present invention both flat surfaces and tridimensional articles can be printed.

As said, the colour transfer on the final support according to the present invention process is carried out by the colour sublimation technique at temperatures preferably in the range 170°–210° C. The contact time is reduced of about 50% with respect to that used by employing the transfer with paper, and it is of about 30 seconds at the temperature of about 200° C. and of about 1 minute at about 190° C. This is an advantage of the present invention and it follows that from the industrial point of view the productivity is almost twice on the basis of the transfer technology known in the art. This advantage is combined with an higher colour amount transfer by single transfer operation; generally the transferred colour amount is in the order of 90% or more. The imagine definition results quite improved with respect to the conventional technology.

Besides the above mentioned properties are combined with a good gloss.

The composite films of the present invention can be applied as well on textiles, on metal surfaces, for instance aluminum, iron, zinc, steel, cast iron, or on polymeric material substrata.

The invention films are generally applied to any surface able to absorb the film colour by sublimation and contemporaneously said surfaces do not decompose at the sublimation temperature.

When the surface is flat and it is a textile, the textile is preferably of synthetic fibers. When the surfaces are made with other material, for instance they are aluminum, iron, zinc, steel or cast iron sheets, or they are non flat surfaces as in the case of tridimensional articles, it is preferable to prepare these surfaces for printing covering them, for example by electrostatic painting, with a polymeric material layer, for example polyester, preferably using powdered thermosetting paints to facilitate the maximum penetration of the sublimable inks.

For the transfer on textiles conventional calenders are used. In all other cases any technique among the known ones allowing to maintain a tight contact between the composite film and the support which must be printed, can be used.

For instance by a suitable membrane an empty space can be made between the composite film and the article to be printed, so that the composite film completely adheres to the article surface, then carrying out the sublimation in oven.

The composite film heated at the sublimation temperature softens and becomes elastic, adhesive and heatschrinkable, thus becoming suitable both for the application on the flat articles and on the tridimensional ones.

The following examples have the purpose to illustrate the invention and are not to be intended as limitative of the scope of the same.

EXAMPLE 1

A polyethylenterephthalate film having a 12 micron thickness metallized on one side with aluminum having a 125 Amstrong thickness, corresponding to an optical density determined by densitometry of 2.1, (metallized film A) is red coloured by rotogravure printing. 8 equal metallized films are prepared by the same method, on which the applied colour amount is equal, respectively, to 70%, 60%, 50%, 40%, 30%, 20%, 10%, 5% of the one being on the composite A.

The receiving support is an aluminum sheet pretreated, by electrostatic painting, with polyester powdered thermosetting paint having a 75 micron thickness. The colour transfer process from the composite is carried out at the temperature of 200° C. and lasts 30 seconds. The residual colour on the composite A is determined by visual comparison with that of each standard above mentioned.

It is thus determined that the residual colour amount on sheet A is equal to 10% with respect to the initial one. Consequently the transferred colour amount is of about 90%.

EXAMPLE 2

Comparative

Example 1 was repeated using, instead of the composite film, a paper sheet available on the market suitable to be used in the transfer printing having a 22 grams/m$^2$ weight. The reference standard samples for the colour intensity are prepared proceeding as described in the previous example, by using paper sheets of the same kind of that used for the sample. The transfer process is carried out at the temperature of 200° C. for 1 minute on receiving supports equal to those used in Example 1.

The residual colour amount on the paper is found to be of about 40%; consequently the transferred colour amount is equal to about 60%.

EXAMPLES 3 AND 4

Comparative

A drawing reproducing wood briar (Example 3) is printed by using firstly the metal film of Example 1 and successively a transfer printing paper sheet mentioned in Example 2.

A drawing reproducing the pine wood grains (Example 4) is printed on two supports of the same kind as those used in the previous Example 3.

The colour transfer on aluminum sheet prepared as previously described, is carried out at the temperature of 200° C. for 30 seconds. The colour transfer on paper samples is carried out in the same conditions for a 1 minute time.

The photos of the so obtained printed prints are reported in the figures as indicated hereinafter:

The file of this patent contains at least one drawing executed in color. Copies of this patent with color drawing (s) will be provided by the Patent and Trademark Office upon request and payment of the necessary fee.

briar drawing (Ex. 3)

Figure 2:
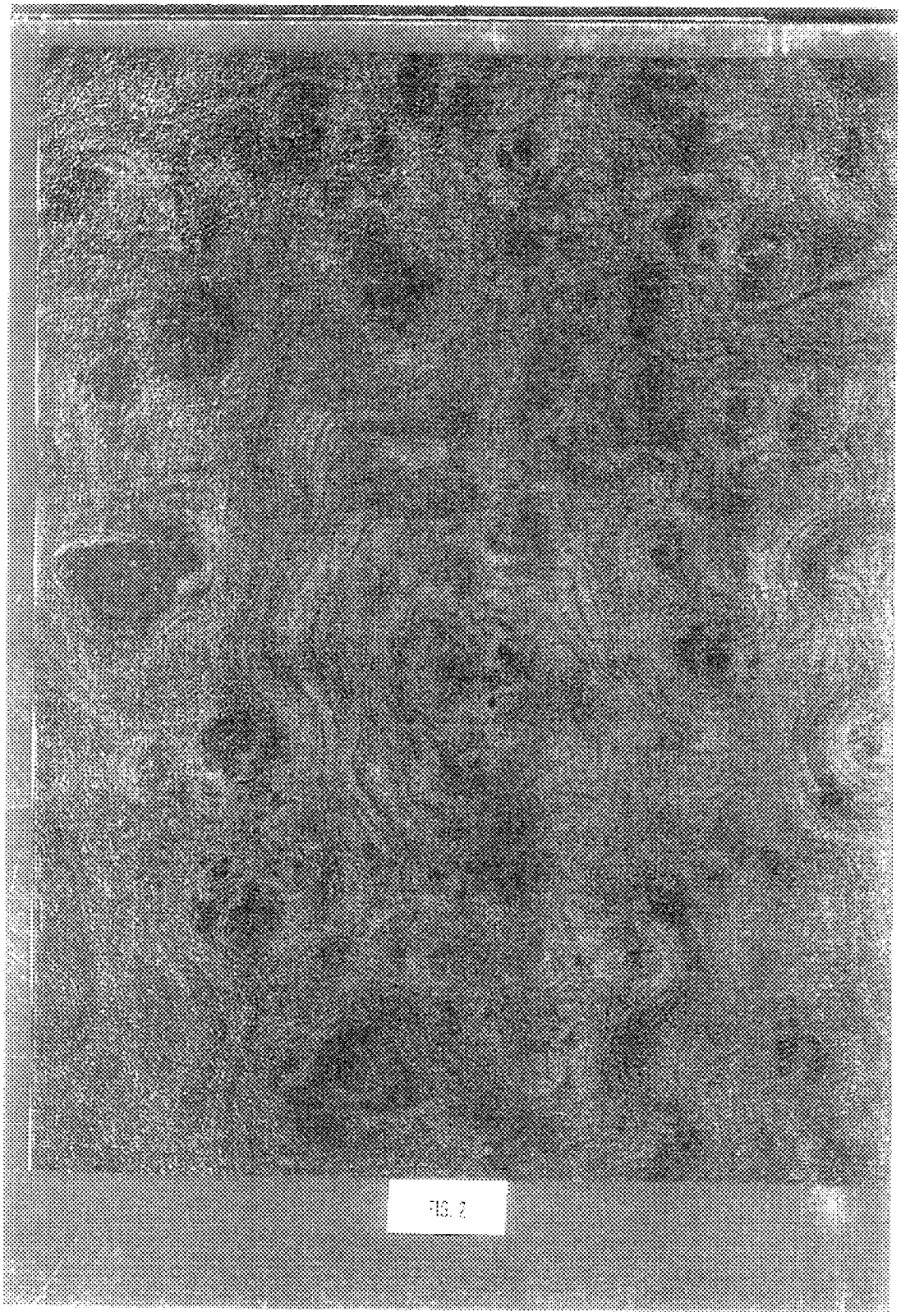

FIG. 1: print obtained from the metallized film;

FIG. 2: (comp) print obtained from the paper;

Drawing reproducing the pine wood grains (Ex. 4)

Figure 3:
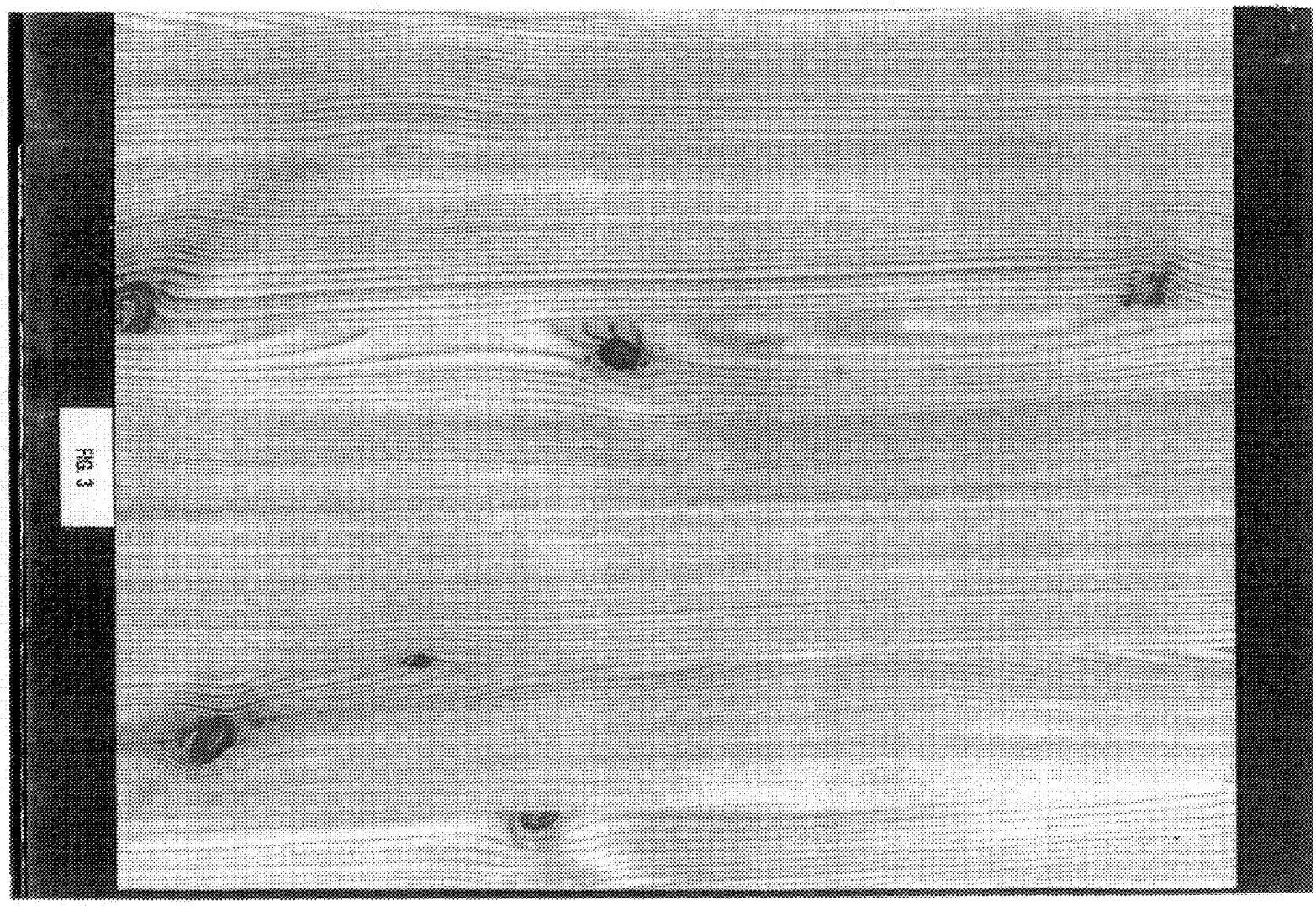
Figure 4:
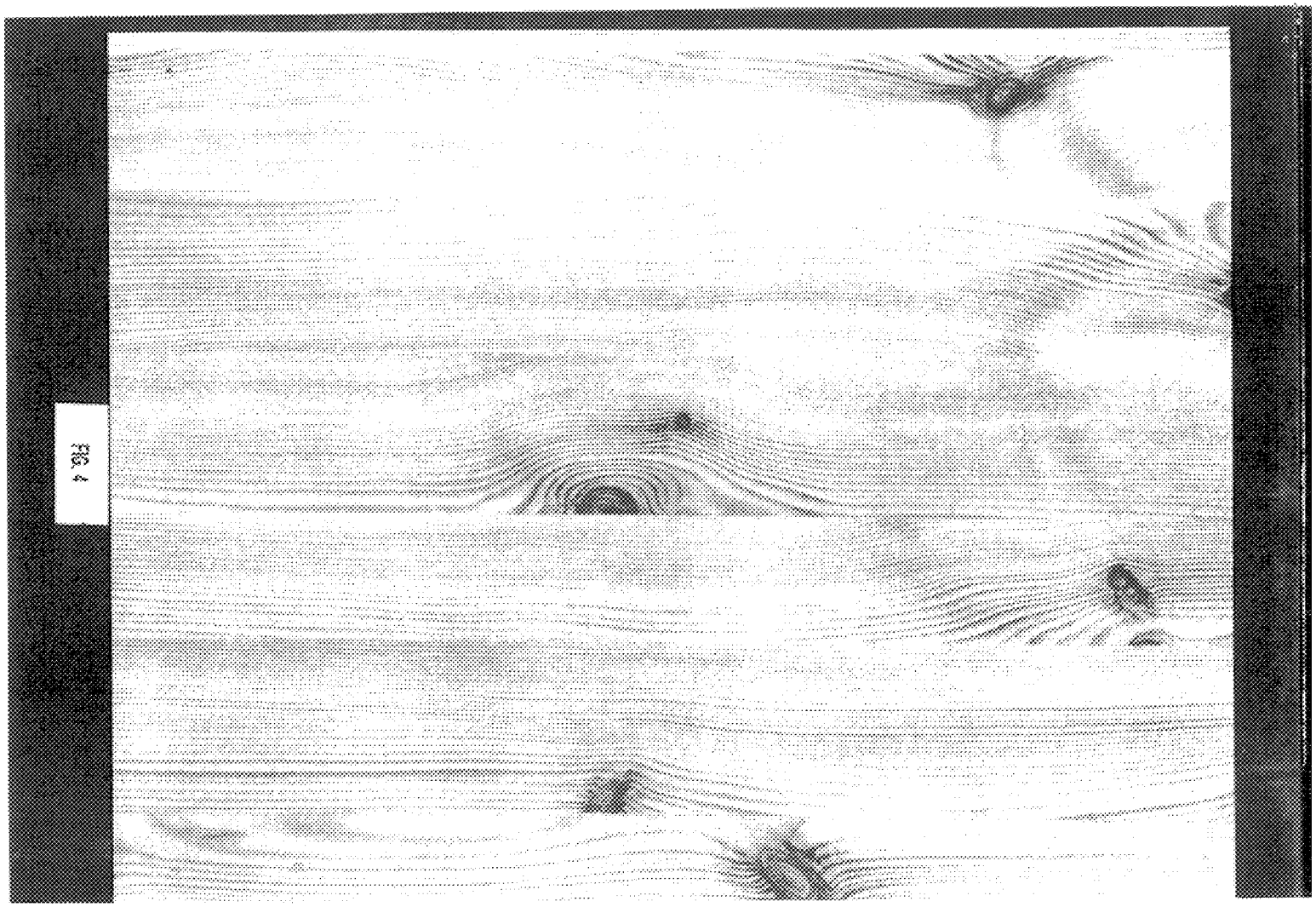

FIG. 3: print obtained by the metallized film;

FIG. 4: (comp) print obtained from the paper.

The obtained printed drawing examination shows that in both cases the quality of the print obtained from the composite according to the invention (FIGS. 1 and 3) is higher as regards both the D.O.I. and the colour tonality yield, than those obtained from the paper (FIGS. 2 and 4).

Specifically, a D.O.I. of 8 has been attributed to the prints mentioned in FIGS. 1 and 3, and a D.O.I. of 5 has been assigned to the ones mentioned in FIGS. 2 and 4.

The D.O.I. has been evaluated by giving to the printed matter a point scale, on the basis of the following value scale from 1 to 10:

| given point scale | D.O.I. evaluation |
|---|---|
| 1–2 | very bad |
| 3–4 | insufficient |
| 5–6 | acceptable |
| 7–8 | good |
| 9–10 | very good |

What is claimed is:

1. A transfer printing process comprising:

(a) applying to a flat or tridimensional surface a composite film having thereon a drawing made with sublimable colors, said composite film consisting of:

(1) a polymeric film as the composite base capable of resisting decomposition at the sublimation temperature, and having a thickness in the range of 6 to 100 microns;

(2) an aluminum layer having a thickness in the range of 50–400 Å deposited on the polymeric film and exhibiting an optical density of 1.5–3.0, and (3) the drawing impressed on the aluminum layer, and (b) transferring said drawing made with sublimable colors by heating the composite and the receiving support at temperatures of 170° C.–210° C., at which color sublimation occurs.

2. The process according to claim 1 wherein the polymeric film of the composite has a thickness of 10–25 microns and comprises polyesters, fluorinated resins, polyamides, polyimides or polyethers.

3. The process according to claim 2 wherein the polymeric material is polyethylene terephathalate or polybutylene terephthalate.

4. The process according to claim 1 wherein the flat surface is a synthetic textile.

5. The process according to claim 1 wherein the surface is aluminum, iron, cast iron, zinc, or steel.

6. The process according to claim 5 wherein the surfaces are tridimensional.

* * * * *